US009188090B2

(12) United States Patent
Pearce et al.

(10) Patent No.: US 9,188,090 B2
(45) Date of Patent: Nov. 17, 2015

(54) MULTI-TUBULAR FUEL VAPOR CANISTER

(71) Applicant: Ford Global Technologies, LLC, Dearborn, MI (US)

(72) Inventors: Russell R. Pearce, Ann Arbor, MI (US); Dennis Seung-Man Yang, Canton, MI (US); Robert G. Ognjanovski, Shelby Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 280 days.

(21) Appl. No.: 13/646,463

(22) Filed: Oct. 5, 2012

(65) Prior Publication Data

US 2014/0096749 A1 Apr. 10, 2014

(51) Int. Cl.
*F02M 25/08* (2006.01)
*F02D 41/00* (2006.01)

(52) U.S. Cl.
CPC ..... *F02M 25/0854* (2013.01); *F02D 41/004* (2013.01); *F02M 25/089* (2013.01); *F02M 25/0836* (2013.01); *F02M 25/0872* (2013.01)

(58) Field of Classification Search
CPC ..... F02M 25/0854; F02M 25/0836; F02M 25/0872; F02M 25/089; F02D 41/004
USPC ..... 123/518–521; 34/580
See application file for complete search history.

(56) References Cited

U.S. PATENT DOCUMENTS

| | | | | | |
|---|---|---|---|---|---|
| 3,575,152 | A * | 4/1971 | Wentworth | ..... | 123/520 |
| 4,386,947 | A | 6/1983 | Mizuno et al. | | |
| 5,165,379 | A * | 11/1992 | Thompson | ..... | 123/520 |
| 5,377,644 | A * | 1/1995 | Krohm | ..... | 123/520 |
| 5,398,660 | A * | 3/1995 | Koyama et al. | ..... | 123/519 |
| 5,564,398 | A * | 10/1996 | Maeda et al. | ..... | 123/520 |
| 5,776,227 | A | 7/1998 | Meiller et al. | | |
| 5,915,364 | A | 6/1999 | Katou et al. | | |
| 6,230,693 | B1 | 5/2001 | Meiller et al. | | |
| 6,689,196 | B2 | 2/2004 | Amano et al. | | |
| 6,695,896 | B2 | 2/2004 | Hara et al. | | |
| 6,905,536 | B2 | 6/2005 | Wright | | |
| 7,160,361 | B2 | 1/2007 | Meiller et al. | | |
| 7,168,417 | B2 | 1/2007 | Arruda et al. | | |
| 7,614,387 | B2 * | 11/2009 | Wang et al. | ..... | 123/519 |
| 7,762,241 | B2 * | 7/2010 | Childress et al. | ..... | 123/520 |
| 2008/0236119 | A1 | 10/2008 | Boland et al. | | |

* cited by examiner

*Primary Examiner* — Stephen K Cronin
*Assistant Examiner* — Robert Werner
(74) *Attorney, Agent, or Firm* — James Dottavio; Alleman Hall McCoy Russell & Tuttle LLP

(57) ABSTRACT

Systems and methods for operating an engine with a fuel vapor recovery system are disclosed. In one example approach, a method for an engine with a fuel vapor recovery system including a multi-tubular fuel vapor canister comprises directing air through a first set of adsorbent passages in the fuel vapor canister to purge fuel vapor therefrom while not directing air through a second set of adsorbent passages in the fuel vapor canister; and directing air through the second set of adsorbent passages to purge fuel vapor therefrom while not directing air through the first set of adsorbent passages.

14 Claims, 5 Drawing Sheets

MULTI-TUBULAR FUEL VAPOR CANISTER

BACKGROUND/SUMMARY

Vehicles may be fitted with fuel vapor recovery systems wherein vaporized hydrocarbons (HCs) released from a fuel tank (for example, during refueling) are captured and stored in a fuel vapor canister packed with an adsorbent, such as activated charcoal or carbon. At a later time, when the engine is in operation, the fuel vapor recovery system may use a vacuum (or pressure) to purge the vapors into the engine intake manifold for use as fuel. The purge flow vacuum (or pressure) may be generated by one or more pumps and/or ejectors or by pressures in the engine intake manifold.

The inventors herein have recognized that with increasingly stringent engine emission standards and reductions in engine manifold vacuums to increase fuel economy it may be desirable to design an evaporative emissions canister that is efficiently cleaned through what little purge air is available. For example, reductions in engine manifold vacuum may reduce an amount of vacuum available to adequately purge fuel vapor stored in a fuel vapor canister resulting in increased emissions. Further, approaches which utilize a pump to provide vacuum to a fuel vapor canister for purging may reduce fuel economy due to parasitic power consumption by the pump.

In order to address these issues, in one example approach, a method for an engine with a fuel vapor recovery system including a multi-tubular fuel vapor canister is provided. The method comprises directing air through a first set of adsorbent passages in the fuel vapor canister to purge fuel vapor therefrom while not directing air through a second set of adsorbent passages in the fuel vapor canister; and directing air through the second set of adsorbent passages to purge fuel vapor therefrom while not directing air through the first set of adsorbent passages. In another example, a method includes flowing purge air through different groups of parallel-tubular fuel vapor canister passages depending on operating conditions.

Such approaches utilize a purge efficient/cost efficient evaporative carbon canister which may be more thoroughly purged with a reduced amount of purge vacuum thus reducing evaporative emissions while increasing engine fuel economy.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
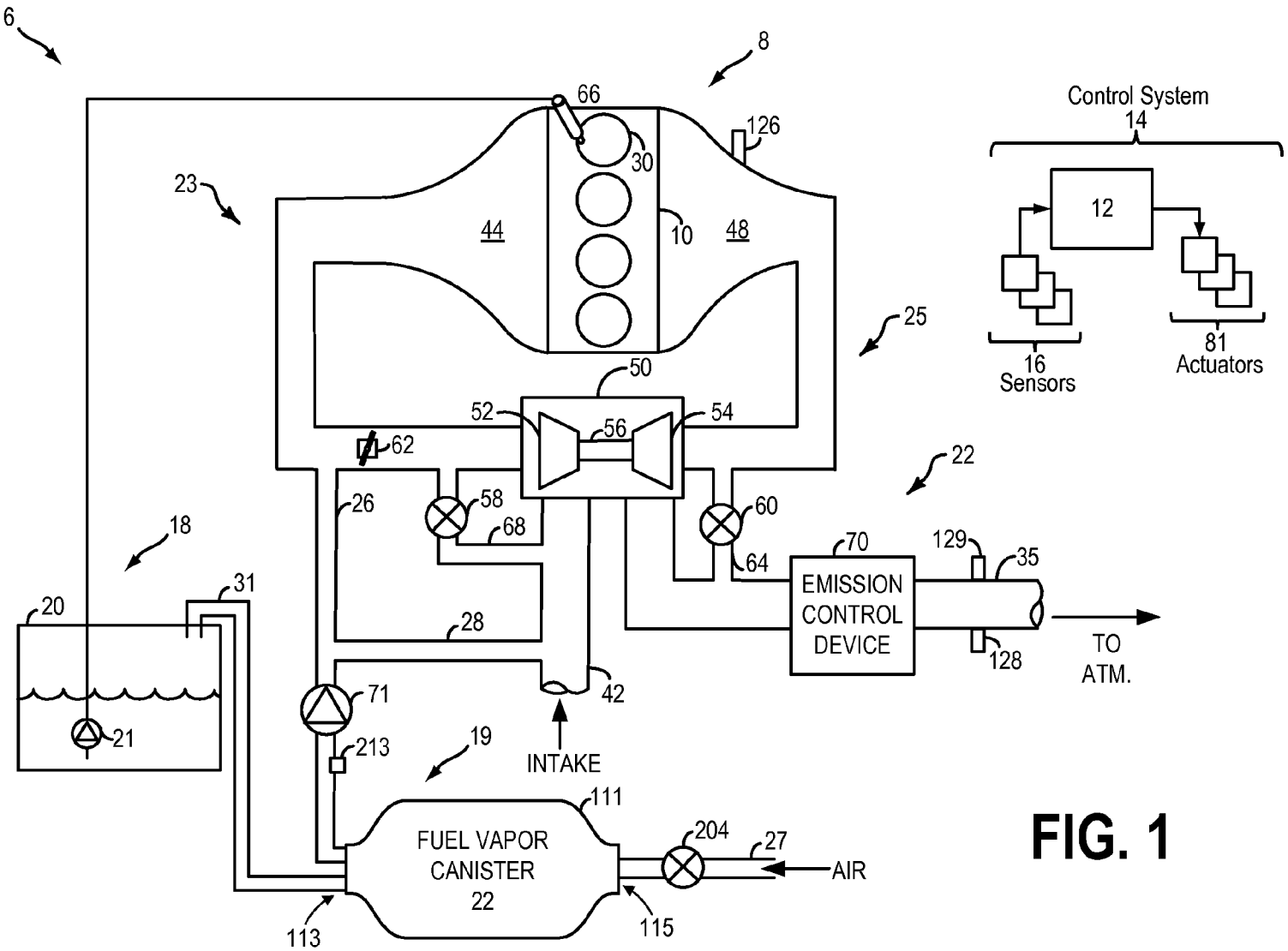
FIG. 1 shows a schematic depiction of an engine with a fuel vapor recovery system.
Figure 2:
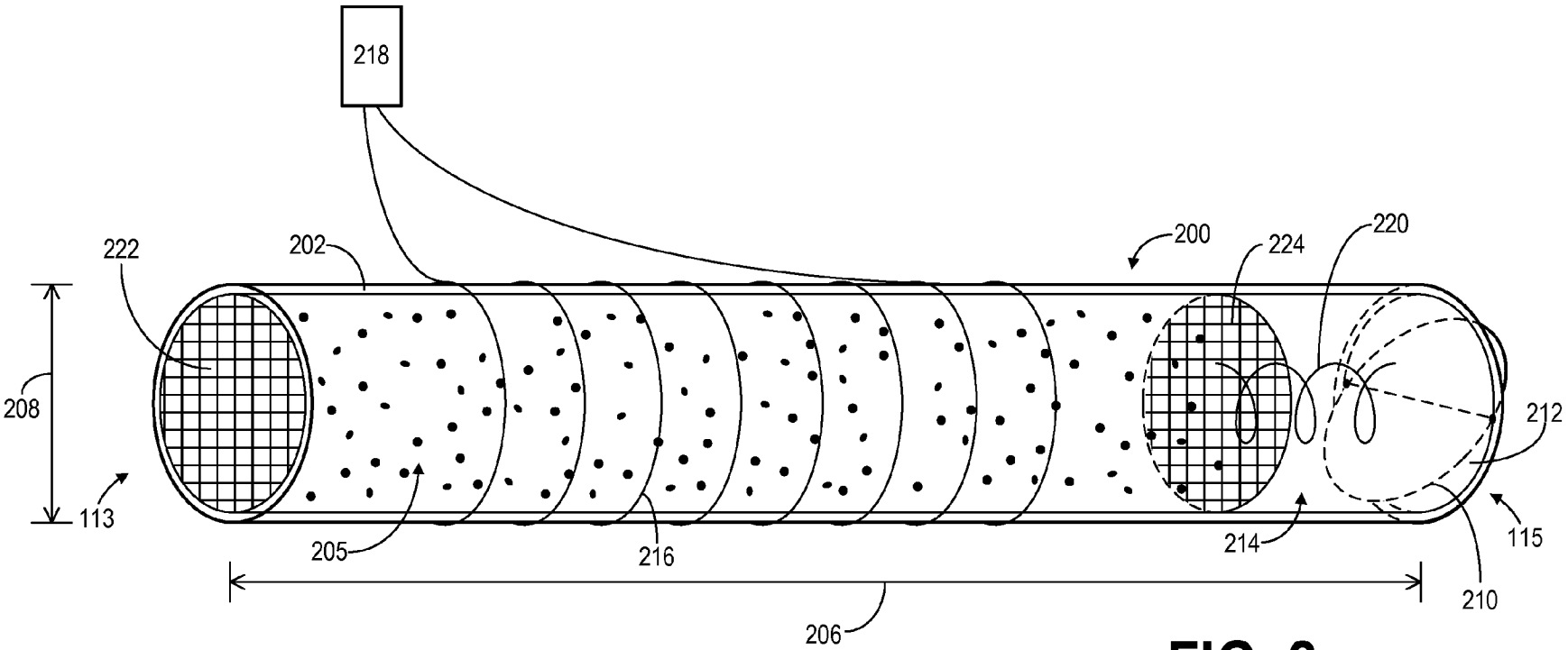
FIG. 2 shows an example passage in a fuel vapor canister in accordance with the disclosure.
Figure 3:
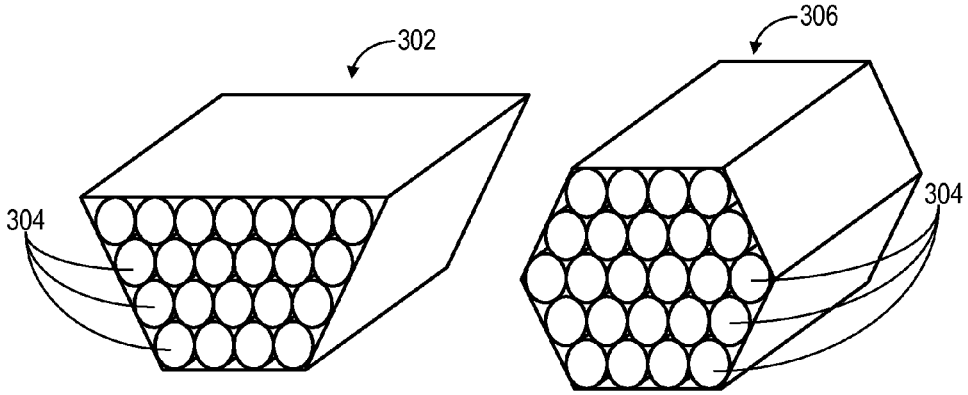
FIGS. 3 and 4 shows example passage configurations in a fuel vapor canister in accordance with the disclosure.
Figure 4:
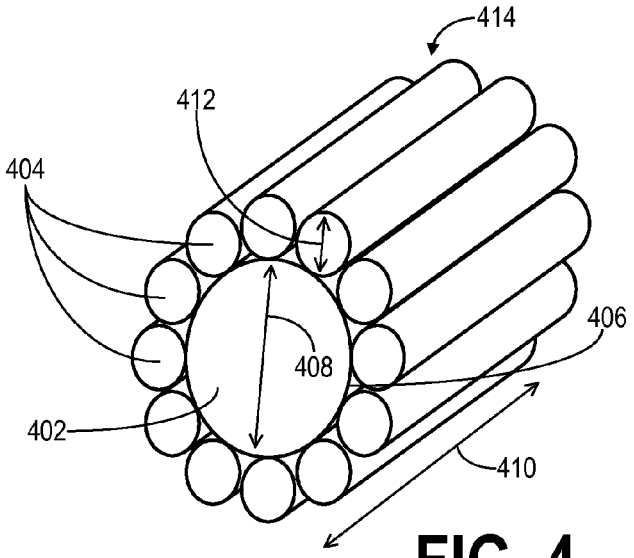
Figure 5:
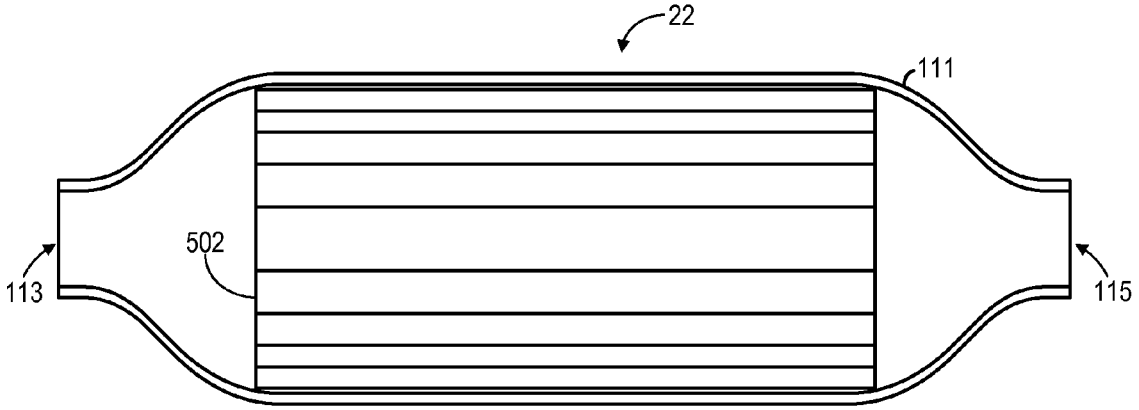
FIG. 5 shows an example fuel vapor canister housing in accordance with the disclosure.
Figure 6:
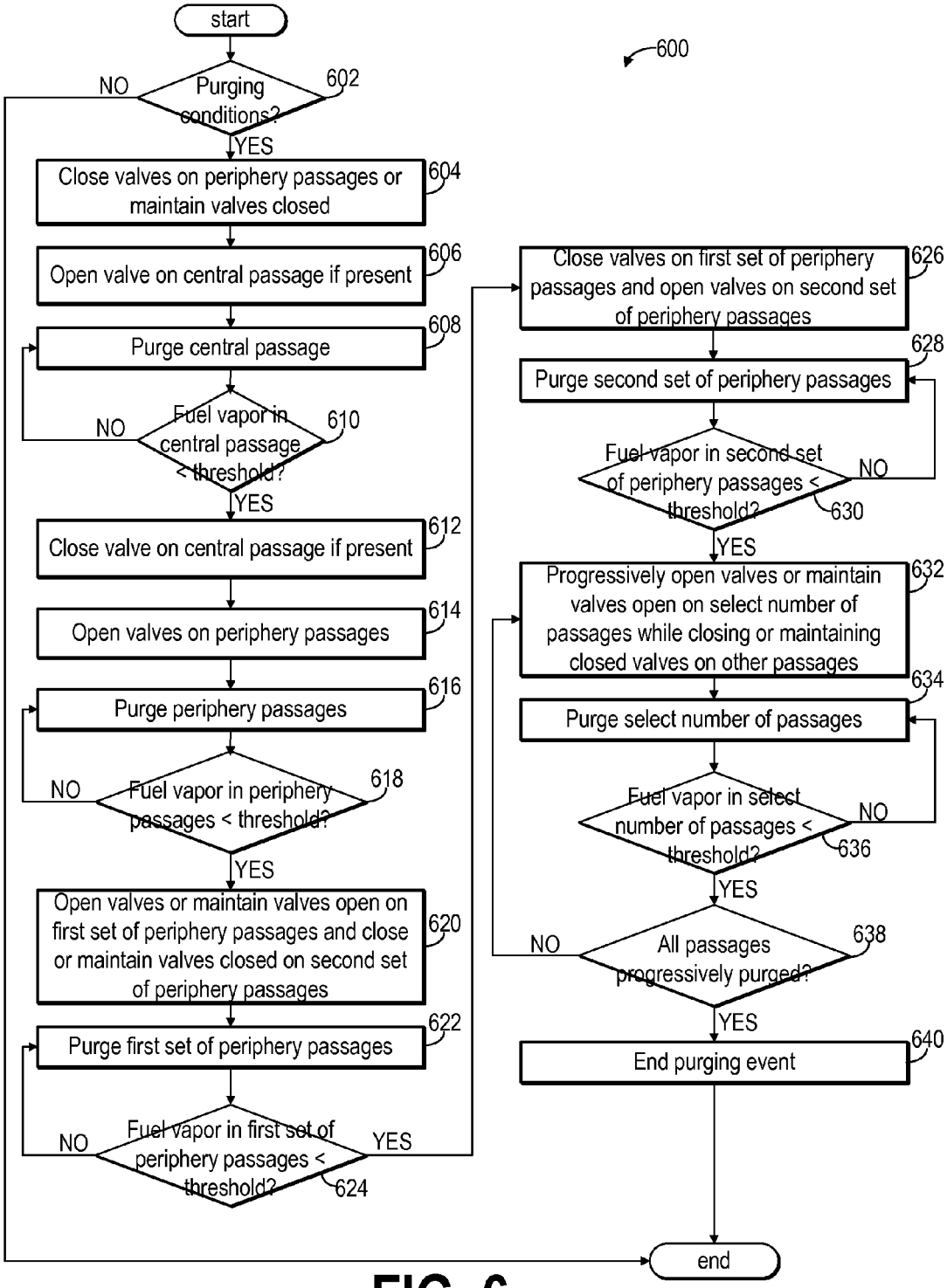
FIG. 6 shows an example method of operating an engine with a fuel vapor canister in accordance with the disclosure.
Figure 7:
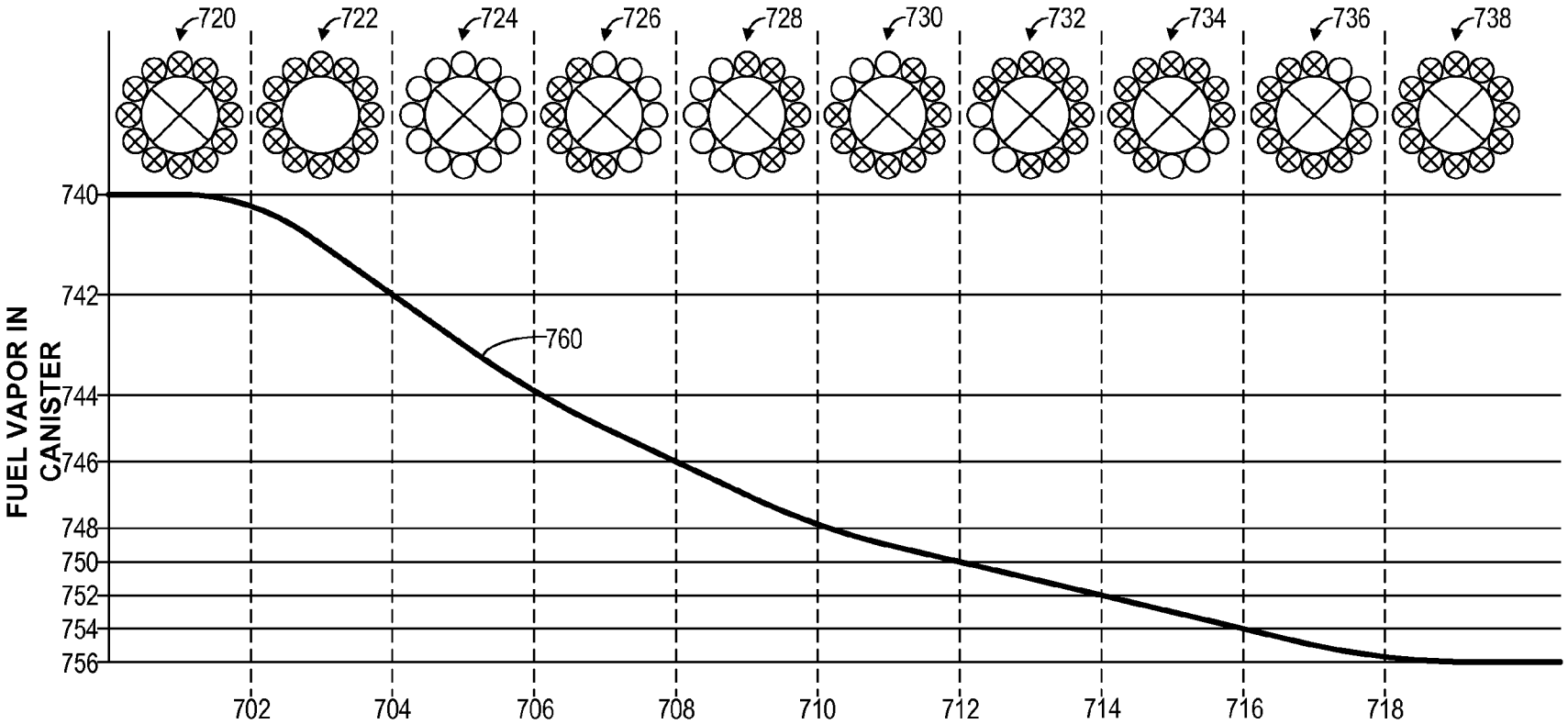
FIG. 7 illustrates an example fuel vapor purging event in accordance with the disclosure.

The following description relates to systems and methods for operating an engine with a fuel vapor recovery system, such as the engine shown in FIG. 1. The fuel vapor recovery system may include a multi-tubular fuel vapor canister which includes a plurality of passages or tubes, such as the example passage shown in FIG. 2, packed together in various configurations as shown in FIGS. 3-4. These tube or passage packing configurations may be included in a common fuel vapor canister housing as shown in FIG. 5. As shown in FIGS. 6-7, a multi-tubular fuel vapor canister in accordance with the disclosure may be operated to purge select passages while not purging other passages and then purge the other passages while not purging the select passages. In this way, the passages in a multi-tubular fuel vapor canister may be progressively and efficiently purged at low purge pressures.

FIG. 1 shows a schematic depiction of a vehicle system 6 including an engine system 8 coupled to a fuel vapor recovery system 19 and a fuel system 18. Fuel vapor recovery system 19 includes a fuel vapor canister 22 which may capture and store vaporized hydrocarbons (HCs) released from a fuel tank (for example, during refueling) in a storage material contained therein. As described in more detail below with regard to FIGS. 2-5, fuel vapor canister 22 may comprise a plurality of mutually exclusive passages arranged in parallel. Each passage in the plurality of passages may include an adsorbent, such as activated charcoal or carbon, or other suitable adsorbent material. Further, each passage may include a valve arranged at the end of the passage which may be opened or closed depending on operating conditions as described below. The passages in the fuel vapor canister may be arranged in various configurations, e.g., as shown below in FIGS. 3-4, in a common housing 111.

The engine system 8 may include an engine 10 having a plurality of cylinders 30. The engine 10 includes an engine intake 23 and an engine exhaust 25. The engine intake 23 includes a throttle 62 fluidly coupled to the engine intake manifold 44 via an intake passage 42. The engine exhaust 25 includes an exhaust manifold 48 leading to an exhaust passage 35 that routes exhaust gas to the atmosphere. The engine exhaust 25 may include one or more emission control devices 70, which may be mounted in a close-coupled position in the exhaust. One or more emission control devices may include a three-way catalyst, lean NOx trap, diesel particulate filter, oxidation catalyst, etc. It will be appreciated that other components may be included in the vehicle system, such as a variety of valves and sensors.

Throttle 62 may be located in intake passage 42 downstream of a boosting device, such as turbocharger 50, or a supercharger. Turbocharger 50 may include a compressor 52, arranged between intake passage 42 and intake manifold 44. Compressor 52 may be at least partially powered by exhaust turbine 54, arranged between exhaust manifold 48 and exhaust passage 35. Compressor 52 may be coupled to exhaust turbine 54 via shaft 56. Compressor 52 may be configured to draw in intake air at atmospheric air pressure and boost it to a higher pressure. Using the boosted intake air, a boosted engine operation may be performed. However, in other examples, engine system 8 may be a normally aspirated engine and may not include a boosting device.

An amount of boost may be controlled, at least in part, by controlling an amount of exhaust gas directed through exhaust turbine 54. In one example, when a larger amount of boost is requested, a larger amount of exhaust gases may be directed through the turbine. Alternatively, for example when a smaller amount of boost is requested, some or all of the exhaust gas may bypass turbine 54 via turbine bypass passage 64, as controlled by wastegate 60. The position of wastegate 60 may be controlled by a wastegate actuator (not shown) as directed by controller 12. In one example, the wastegate actuator may be a vacuum-driven solenoid valve.

An amount of boost may additionally or optionally be controlled by controlling an amount of intake air directed through compressor 52. Controller 12 may adjust an amount of intake air that is drawn through compressor 52 by adjusting the position of compressor bypass valve 58 in compressor bypass passage 68. In one example, when a larger amount of boost is requested, a smaller amount of intake air may be directed through the compressor bypass passage.

Fuel system 18 may include a fuel tank 20 coupled to a fuel pump system 21. The fuel pump system 21 may include one or more pumps for pressurizing fuel delivered to fuel injectors 66 of engine 10. While only a single fuel injector 66 is shown, additional injectors are provided for each cylinder. It will be appreciated that fuel system 18 may be a return-less fuel system, a return fuel system, or various other types of fuel system. A fuel pump may be configured to draw the tank's liquid from the tank bottom.

Vapors generated in fuel system 18 may be routed to a fuel vapor canister 22 via conduit 31, before being purged to the engine intake 23. During a purging condition, air may be selectively drawn in through one or more passages in the fuel vapor canister through vent 27 and canister vent valve 204. Fuel tank vapors may be vented through the tank top. The fuel tank 20 may hold a plurality of fuels, including fuel blends. Conduits 31 and 26 may be coupled to an end 113 of canister housing 111 while vent 27 may be coupled to an end 115 of housing 111 opposing end 113.

Fuel vapors stored in fuel vapor recovery system may be purged to engine intake 23 during purging conditions. Specifically, a purge flow may be driven by purge pump 71, and may be directed to the engine intake post-throttle, along first conduit 26, and/or into the pre-compressor engine air inlet, along second conduit 28. In some examples, an ejector may be coupled, in series, downstream of the purge pump to generate a vacuum for purging. However, in other examples, a purge valve may be disposed in conduit 26 and opened during fuel vapor purging events so that vacuum generated in the engine intake manifold may be used to purge fuel vapor from the fuel vapor canister. In some examples, such a purge valve may be used in addition to an ejector and/or pump to provide vacuum to the fuel vapor canister during purging.

Vehicle system 6 may further include control system 14. Control system 14 is shown receiving information from a plurality of sensors 16 and sending control signals to a plurality of actuators 81. As one example, sensors 16 may include exhaust gas sensor 126 (located in exhaust manifold 48), temperature sensor 128 and pressure sensor 129 (located downstream of emission control device 70). Other sensors such as additional pressure, temperature, air/fuel ratio, and composition sensors may be coupled to various locations in the vehicle system 6. Further, a sensor 213 may be included in conduit 26 to measure an amount of fuel being purged from fuel vapor canister 22 or each passage in the fuel vapor canister may include a sensor for determining an amount of fuel vapor, e.g., a concentration or a fuel fraction, stored in the passage. These sensors may be air/fuel sensors or any other suitable sensor for measuring an amount of fuel vapor. As another example, actuators 81 may include fuel injectors 66, throttle 62, compressor 52, purge pump 71, a fuel pump of pump system 21, wastegate 60, wastegate actuators, compressor bypass valve 58, etc. The control system 14 may include an electronic controller 12. The controller may receive input data from the various sensors, process the input data, and trigger the actuators in response to the processed input data based on instruction or code programmed therein corresponding to one or more routines.

As remarked above, fuel vapor canister 22 may be comprised of a plurality of mutually exclusive tubes or passages, where each passage contains a suitable adsorbent material for capturing and storing fuel vapors. FIG. 2 shows an example passage 200 or tube in a fuel vapor canister. Passage 200 may be a tubular shell with exterior walls 202 filled with a suitable fuel vapor adsorbent 205 such as activated charcoal in granular or pellet form.

A cross-section of passage 200 may be any suitable shape. For example, a cross section of passage 200 may be circular (as shown in FIG. 2), oval, polygonal, e.g., hexagonal, octagonal, square, or any other suitable shape. In some examples, the shape of the cross-section may be chosen based on a desired packaging of a plurality of the passages, examples of which are shown in FIGS. 3-4. Further, the cross-section of passage 200 may be chosen to increase flow efficiency through passage 200 and reduce restriction of flow through passage 200. For example, as shown in FIG. 2, passage 200 may be cylindrical in shape; however, in other examples, passage 200 may be box-shaped or have other suitable shapes.

A length 206 in a direction from end 113 to opposing end 115 of canister 22 may be greater than a width 208 of passage 200. During a purge event, air may be drawn from vent 27 through end 115 towards end 113 so that fuel vapor is directed into conduit 26. However, during a venting event, such as during refueling, air and fuel vapor may flow from conduit 31 through end 113, through adsorbent 205 towards end 115 of canister 22.

In some examples, passage 200 may include a valve 210 coupled to an end of the passage. For example, valve 210 may be disposed in passage 200 adjacent to end 115 of canister 22. In some examples, valve 210 may be coupled in the opening 212 in passage 200 at end 115. However, in other examples, valve 210 may be disposed in an interior 214 of passage 200. Valve 210 may be separated from the adsorbent material contained in passage 200.

Valve 210 may be any suitable valve configured to be opened or closed depending on operating conditions. In some examples, valve 210 may be a variable position valve configured to be partially opened or closed depending on operating conditions. For example, in response to an actuation event as described in more detail below, controller 12 may be configured to open valve 210 during a first condition and close valve 210 during a second condition. For example, during a purge event, valve 210 may be opened to purge fuel vapor from passage 200 and then closed to purge other passages in canister 22. Further, valve 210 may be closed during other times to reduce bleed emissions during non-venting events, e.g., during engine or vehicle resting events. In some examples, valve 210 may also be opened during a venting event such as refueling; however, in other examples, valve 210 may remain closed during venting events.

In some examples, the exterior wall 202 of passage 200 may include an electrically resistant material for selective heating of the passage. For example, in response to a condition, controller 12 may be configured to increase a current through the electrically resistant material and discontinue current supplied to the electrically resistant material in response to a second condition. For example, passage 200 may be heated via a current supplied to the electrically resistant material only when fuel vapor is being purged from passage 200. Thus, the first condition may be when the valve 210 on the end of the passage is in an open position and the second condition may be when the valve 210 transitions from an open to closed position.

In some examples, the electrically resistant material may include wires 216 wrapped around or within the walls 202 of passage 200 for inductive heating of the passage. The wires 216 may be coupled to a current source 218, for example. As another example, an electrically conductive material may line a portion of an exterior or interior of the walls of passage 200 for heating passage 200 during select conditions. For example, by selectively heating the passage 200 while purging the passage, fuel vapors stored in passage 200 may be released while using a reduced purge vacuum and less energy for air flow.

The adsorbent material 205 may be held in place within passage 200 in any suitable manner. In one example, as shown for example in FIG. 2, the adsorbent 205 may be held in place by a compression spring 220 of sufficient force to maintain compression on the adsorbent material in the passage to reduce occurrences of loose packing of the adsorbent. The adsorbent could be constrained by a mesh screen 222 on an end of the adsorbent bed opposing spring 220. Another constraint, for example mesh 224, may be in contact with a force of spring 220 to hold the adsorbent in place. A size of the mesh may be dependent on a size of the particles of the hydrocarbon storage media 205, for example.

As remarked above, fuel vapor canister 22 may be comprised of a plurality of mutually exclusive tubes or passages packed together in a packing configuration and included in a common housing. For example, a plurality of, e.g., three or more, passages similar to the passage shown and described above with regard to FIG. 2 may be packed or bundled together to create a carbon canister sufficient for a vehicle-specific onboard refueling vapor recovery capacity. For example, the number of passages, the shape and size of the passages, and the configuration of a packaging of the passages may be varied based on a particular vehicle and engine application. For example, the tubes in this bundle could all be of one length or multiple lengths and they could be of a consistent cross-section or many different cross-sections. For example, they could be bundled into a cylinder or a quadrilateral box or any other suitable configuration.

FIG. 3 shows two different example passage packaging configurations. At 302, a quadrilateral box configuration of a plurality of passages 304 bundled together in a box-shape is shown. At 306, a hexagonal box configuration of a plurality of passages 304 bundled into a hexagonal box shape is shown. It should be understood that the example configurations shown in FIG. 3 are exemplary and various other packing configurations are contemplated.

Each passage in the plurality of passages may be mutually exclusive so that the passage is not in fluid communication with any other passage throughout a length of the passage. Further, the passages in a plurality of passages may be arranged in parallel so that a direction of flow through each passage in the plurality of passages is substantially the same.

In some examples, a fuel vapor canister in accordance with the disclosure may include a larger passage or tube together with a plurality of smaller passages or tubes. For example, FIG. 4 shows a passage packing configuration 414 with a central passage 402 packed together with a plurality of passages 404. The plurality of passages 404 may be periphery passages positioned around an outer wall 406 of central passage 402. Central passage 402 may have a larger cross-sectional area than the cross-sectional areas of each passage in the plurality of passages 404. For example, central passage 402 may be a central larger tube with a diameter 408 of approximately two inches and a length 410 between approximately eight to twelve inches.

All passages in the plurality of passages 404 and the central passage 402 may be mutually exclusive and may be arranged in parallel as shown in FIG. 4. Further, in some examples, each passage in the plurality of passages 404 may have substantially the same length as the central passage. However, in other examples, the lengths of the passages may vary. Further, the diameter of each passage in the plurality of passages 404, e.g., diameter 412, may be less than, e.g., less than half, the diameter 408 of central passage 402.

In some examples, central passage 402 may be similar to the passage shown in FIG. 2 described above and may include a suitable adsorbent and a valve at an end of the central passage adjacent to side 115 of canister 22. However, in other examples, central passage 402 may not include a valve so that central passage 402 is open at both ends at all times. Thus, in some examples, the center tube may be open to atmosphere so as to allow the system to constantly breathe and to reduce excessive pressures or vacuums in the system. Further, in some examples, central passage may be heated as described above with regard to FIG. 2.

As remarked above, the packaging configurations of passages may be arranged in a common housing 111. For example, FIG. 5 shows a packaging of passages 502 arranged in a common housing 111 of fuel vapor canister 22. For example, packaging of passages 502 may be packing configuration 302, 306, or 414 described above with regard to FIGS. 3-4. However, packaging of passages 502 may be in another configuration not shown in FIGS. 3-4.

FIG. 6 shows an example method 600 of operating an engine with a fuel vapor canister with a multi-tubular canister to selectively and progressively purge individual passages and/or groups of passages in the canister.

At 602, method 600 includes determining if purging conditions are met. Purging conditions may be confirmed based on various engine and vehicle operating parameters, including an amount of hydrocarbons stored in canister 22 being greater than a threshold, the temperature of emission control device 70 being greater than a threshold, a temperature of canister 22, fuel temperature, the number of engine starts since the last purge operation (such as the number of starts being greater than a threshold), a duration elapsed since the last purge operation, fuel properties, and various others.

If purging conditions are met at 602, method 600 proceeds to 604 to close valves on periphery passages or maintain valves on periphery passages closed. For example, for each passage in the plurality of passages 404 shown in FIG. 4, a valve, e.g., valve 210 may be adjusted to a closed position so that no air is directed through any of the smaller periphery passages arranged around the larger central passage.

At 606, method 600 includes opening a valve on a central passage if a valve is present on the central passage. As remarked above, in some examples, central passage 402 shown in FIG. 4 may include a valve, such as valve 210 at an end of the central passage adjacent to side 115 of canister 22. If the central passage includes such a valve, then the valve is opened at 606 to permit air to flow through the central passage to purge fuel vapor stored in the adsorbent material of the central passage. However, in other examples, the central passage may not include any valves and may instead be open to the atmosphere for venting purposes. In this case, no action may take place at 606.

At 608, method 600 includes purging the central passage. In particular, air is directed through the central passage to purge fuel vapor from the central passage before directing air through periphery passages. For example, a purge vacuum draws air from vent 27 through the adsorbent in central passage 402 to purge any fuel vapor therefrom. Since the valves on the periphery passages are closed, no air is directed through any of the peripheral passages during this step.

Further, in some examples, the central passage may be heated during a purging of the central passages. For example, current may be supplied to an electrically resistance material in or along the walls of the central passage in response to a valve on the end of the central passage opening or in response to an indication that the central passage is being purged. Heating of the central passage may be discontinued when purging of the central passage terminates.

At 610, method 600 includes determining if fuel vapor in the central passage is less than a threshold. For example, an amount of fuel vapor stored in the central passage or in the entire canister may be monitored and used to determine when a threshold amount, e.g., concentration or mass, of fuel vapor has been purged from the central passage or the canister. As another example, an amount of fuel vapor purged from the canister may be monitored, e.g., via sensor 213, to determine when an amount of fuel vapor purged from the canister falls below this threshold.

If fuel vapor in the central passage is not less than the threshold at 610, method 600 continues to purge the central passage at 608. However, if fuel vapor in the central passage is less than the threshold at 610, method 600 proceeds to 612.

At 612, method 600 includes closing the valve on the central passage if present. However, if the central passage does not include any valve, then the central passage may remain open for the duration of the method.

At 614, method 600 includes opening valves on the periphery passages. For example, valves on all of the periphery passages may be opened so that air may be directed through the periphery passages for an initial purging of the periphery passages.

At 616, method 600 includes purging the periphery passages. In particular air is directed through the periphery passages from vent 27, to at least partially purge fuel vapor stored in the adsorbent material inside each periphery passage. Further, in this step, each passage in the plurality of peripheral passages may be individually heated, e.g., by increasing a current supplied to an electrically resistance material in the walls of the passage. Heating of a passage may be discontinued upon termination of purging of the passage or when a valve on the passage is closed.

At 618, method 600 includes determining if fuel vapor in the periphery passages is less than a threshold. For example, an amount of fuel vapor stored in the periphery passages or in the entire canister may be monitored and used to determine when a threshold amount, e.g., concentration or mass, of fuel vapor has been purged from the periphery passages or the canister. As another example, an amount of fuel vapor purged from the canister may be monitored, e.g., via sensor 213, to determine when an amount of fuel vapor purged from the canister falls below this threshold.

If fuel vapor in the periphery passages is not less than the threshold at 618, method 600 continues to purge the periphery passages at 616. However, if fuel vapor in the periphery passages is less than the threshold at 618, method 600 proceeds to 620.

At 620, method 600 includes opening valves or maintaining valves open on a first set of periphery passages and closing or maintaining closed valves on a second set of periphery passages. For example, valves on half of the periphery passages may remain open while valves on the other half of periphery passages are closed. However, any two sets of periphery passages may be used in this step so that the valves on the first set of passages remain open while the valves on the second set are closed so that the first set of passages are selectively purged while the passages in the second set are not purged.

At 622, method 600 includes purging the first set of periphery passages. In particular, air may be directed through the first set of adsorbent passages in the fuel vapor canister to purge fuel vapor therefrom while not directing air through the second set of adsorbent passages in the fuel vapor canister. Directing air through the first set of adsorbent passages in a fuel vapor canister to purge fuel vapor therefrom while not directing air through the second set of adsorbent passages in the fuel vapor canister may include opening a valve on an end of each passage in the first set of passages and closing or maintaining closed a valve on an end of each passage in the second set of passages. Further, in this step, each passage in the first set of passages may be individually heated, e.g., by increasing a current supplied to an electrically resistance material in the walls of the passage while air is being directed through the first set of passages. Heating of a passage may be discontinued upon termination of purging of the passage or when a valve on the passage is closed.

At 624, method 600 includes determining if fuel vapor in the first set of periphery passages is less than a threshold. For example, an amount of fuel vapor stored in the first set of periphery passages or in the entire canister may be monitored and used to determine when a threshold amount, e.g., concentration or mass, of fuel vapor has been purged from the first set of periphery passages or the canister. As another example, an amount of fuel vapor purged from the canister may be monitored, e.g., via sensor 213, to determine when an amount of fuel vapor purged from the canister falls below this threshold.

If fuel vapor in the first set of periphery passages is not less than the threshold at 624, method 600 continues to purge the first set of periphery passages at 622. However, if fuel vapor in the first set of periphery passages is less than the threshold at 624, method 600 proceeds to 626.

At 626, method 600 includes closing valves on the first set of periphery passages and opening valves on the second set of periphery passages and at 628, method 600 includes purging the second set of periphery passages. In particular, air from vent 27 may be directed through each passage in the second set of passages while not being directed through each passage in the first set of passages. Further, in this step, each passage in the second set of passages may be individually heated while each passage in the first set of passage is not heated. Individually heating each passage in the second set of passages may include increasing a current supplied to an electrically resistance material in the walls of the passage while air is being directed through the first set of passages. Heating of a passage may be discontinued upon termination of purging of the passage or when a valve on the passage is closed.

At 630, method 600 includes determining if fuel vapor in the second set of periphery passages is less than a threshold. For example, an amount of fuel vapor stored in the second set of periphery passages or in the entire canister may be monitored and used to determine when a threshold amount, e.g., concentration or mass, of fuel vapor has been purged from the second set of periphery passages or the canister. As another example, an amount of fuel vapor purged from the canister may be monitored, e.g., via sensor 213, to determine when an amount of fuel vapor purged from the canister falls below this threshold.

If fuel vapor in the second set of periphery passages is not less than the threshold at 630, method 600 continues to purge the second set of periphery passages at 628. However, if fuel vapor in the second set of periphery passages is less than the threshold at 630, method 600 proceeds to 632.

At 632, method 600 includes progressively opening valves or maintaining valves open on a select number of passages while closing or maintaining closed valves on the other passages. For example, valves on each passage in a third set of passages may be opened whereas valves on the other passages may be closed to further purge the passages in the third set of passages. After the third set of passages has been purged, a fourth set of passages may then be purged, and so forth.

At 634, method 600 includes purging the select number of passages. In particular, air is directed from vent 27 through the select number of passages to purge the select number of passages while not purging the other passages. The select number of passages may again be individually heated while being purged in this step.

At 636, method 600 includes determining if fuel vapor in the select number of passages is less than a threshold. For example, an amount of fuel vapor stored in the select number of passages or in the entire canister may be monitored and used to determine when a threshold amount, e.g., concentration or mass, of fuel vapor has been purged from the select number of passages or the canister. As another example, an amount of fuel vapor purged from the canister may be monitored, e.g., via sensor 213, to determine when an amount of fuel vapor purged from the canister falls below this threshold.

If fuel vapor in the select number of passages is not less than the threshold at 636, method 600 continues to purge the select number of passages at 634. However, if fuel vapor in the select number of passages is less than the threshold at 636, method 600 proceeds to 638.

At 638, method 600 includes determining if all passages in the fuel vapor canister have been progressively purged. For example, after purging the select number of passages, another different set of passages may be selected and opened for purging. This progressive purging may continue until all passages have been progressively purged.

If all passages in the canister have not been progressively purged at 638, method 600 returns to 632 to continue progressively purging select numbers of passages as described above. However, if all passages have been progressively purged at 638, method 600 proceeds to 640.

At 640, method 600 includes ending or terminating the fuel vapor purge event. Ending the fuel vapor purge event may include closing vent valve 204. Additionally, a fuel injection to the engine may be adjusted during a transition between purging and non-purging conditions. The adjustment may include, for example, adjusting fuel injection responsive to the purge flow during purging conditions, and adjusting fuel injection responsive to the air flow during non-purging conditions. Further, terminating the fuel vapor purge event may additionally include closing all valves on all passages in the fuel vapor canister.

FIG. 7 illustrates an example fuel vapor purging event in accordance with the disclosure. For example, FIG. 7 may illustrate an example implementation of method 600 on a fuel vapor canister with the passage packing configuration shown in FIG. 4. In the illustration of FIG. 7, different groups of passages are selectively and progressively purged by adjusting valves in the passage to increase an efficiency of the purging event even at low purge vacuum. At the top of FIG. 7, different valve openings and closures are shown in the configurations 720, 722, 724, 726, 728, 730, 732, 734, 736, and 738. In these configurations a passage with a cross inside indicates a closed valve whereas an empty passage indicates an open valve.

Prior to an initiation of a purge event at time 702, all valves on all passages may be closed as indicated at 720. However, in some examples, the central passage may not include a valve so that the central passage remains open throughout the entire process. The amount of fuel vapor in the canister, as shown by line 760 is shown at a threshold 740 which may be a threshold value at which at purge event is initiated.

At time 702, for example in response to an amount of fuel vapor in the canister increasing to threshold 740, a purge is initiated. In response to the purge initiation the valve on the central passage is opened whereas the valves on all the periphery passages remain closed as shown at 722.

The central passage is then purged until fuel vapor in the canister decreases to threshold 742 at time 704, at which point all valves on all peripheral passages are opened and the valve (if present) on the central passage is closed as shown at 724.

All periphery passages are then purged until an amount of fuel vapor in the canister further decreases to a threshold 744 at time 706, at which point half of the periphery passages are closed and the other half remain open as shown at 726.

The opened half of periphery passages are then purged without purging any of the other passages until the amount of fuel vapor in the canister further decreases to a threshold 746 at time 708, at which point the opened half of the passages are closed and the closed half of periphery passages are opened as shown at 728.

The newly opened half of periphery passages are then purged without purging any of the other passages until the amount of fuel vapor in the canister further decreases to a threshold 748 at time 710, at which point all valves on the periphery passages are closed except for a select number of passages which are opened or remain open. For example, as shown at 730, three consecutive periphery passages are opened and all the other passages are closed.

The select number of opened passages is then purged until an amount of fuel vapor in the canister decreases further to a threshold 750 at time 712, at which point a next group of select periphery passages are opened and the other passages are closed or remain closed. For example, as shown at 732, another, different group of three passages are opened and the other passages are closed or remain closed.

This next select group of periphery passages is then purged until an amount of fuel vapor in the canister decreases further to a threshold 752 at time 714, at which point a next group of select periphery passages are opened and the other passages are closed or remain closed. For example, as shown at 734, yet another, different group of three passages are opened and the other passages are closed or remain closed.

This next select group of periphery passages is then purged until an amount of fuel vapor in the canister decreases further to a threshold 754 at time 716, at which point a next group of select periphery passages are opened and the other passages are closed or remain closed. For example, as shown at 736, the final group of three passages is opened and the other passages are closed or remain closed. This final select number of opened passages is then purged until an amount of fuel vapor in the canister decreases further to a threshold 756 at time 718, at which point the purging event is terminated and all valves on all passages are again closed.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described diagnostic routines. The subject matter of the present disclosure includes all novel and nonobvious combinations and subcombinations of the various systems and configurations, and other features, functions, and/or properties disclosed herein.

The invention claimed is:

1. A method for an engine with a fuel vapor recovery system, comprising:

directing air through a first set of adsorbent passages in a fuel vapor canister to purge fuel vapor therefrom while not directing air through a second set of adsorbent passages in the fuel vapor canister in response to a fuel vapor purging initiation event;

directing air through the second set of adsorbent passages to purge fuel vapor therefrom while not directing air through the first set of adsorbent passages in response to an amount of fuel vapor in the first set of passages being less than a first threshold, the first and second sets bundled in a hexagonal box-shape in a common housing of the canister, wherein the first and second set of adsorbent passages are arranged around the circumference of an exterior wall of a central adsorbent passage in the fuel vapor canister;

directing air through a select first number of consecutive passages of the second set of adsorbent passages arranged around the circumference of the exterior wall of the central adsorbent passage, the first number of consecutive passages less than a total number of passages of the second set of adsorbent passages, and not directing air through all other passages of the first and second sets of adsorbent passages in response to a second amount of fuel vapor in the second set of passages less than a second threshold; and progressively directing air through a next, different select first number of consecutive passages of the first and second set of adsorbent passages and not directing air through all other passages of the first and second sets of adsorbent passages until all passages of the first and second set of adsorbent passages are progressively purged.

2. The method of claim 1, wherein each of the next, different select first number of consecutive passages is adjacent to a last select first number of consecutive passages around the circumference of the exterior wall of the central adsorbent passage.

3. The method of claim 1, wherein directing air through a first set of adsorbent passages in a fuel vapor canister to purge fuel vapor therefrom while not directing air through a second set of adsorbent passages in the fuel vapor canister includes opening a valve on an end of each passage in the first set of passages and closing or maintaining closed a valve on an end of each passage in the second set of passages, and wherein directing air through the second set of adsorbent passages to purge fuel vapor therefrom while not directing air through the first set of adsorbent passages includes closing the valve on the end of each passage in the first set of passages and opening the valve on the end of each passage in the second set of passages, each of the first and second sets including at least two passages.

4. The method of claim 1, further comprising individually heating each passage in the first set of passages while directing air through the first set of passages and individually heating each passage in the second set of passages while directing air through the second set of passages.

5. The method of claim 1, further comprising directing air through the central adsorbent passage to purge fuel vapor from the central adsorbent passage before directing air through the first and second sets of passages.

6. The method of claim 5, further comprising heating the central adsorbent passage while directing air through the central adsorbent passage.

7. The method of claim 5, further comprising directing air through the central adsorbent passage while directing air through the first and second sets of passages.

8. The method of claim 5, further comprising not directing air through the central adsorbent passage while directing air through the first and second sets of passages.

9. The method of claim 8, wherein directing air through the central adsorbent passage includes opening a valve at an end of the central adsorbent passage and not directing air through the central adsorbent passage includes closing the valve at the end of the central passage.

10. A system for an engine with a fuel recovery system, comprising:

a fuel vapor canister, comprising:

a common housing with a first common opening at a first end of the housing coupled to a fuel tank and an engine intake and a second common opening at a second end of the housing coupled to a vent to atmosphere; and a plurality of smaller parallel and mutually exclusive peripheral adsorbent passages arranged around a larger central adsorbent passage, each passage in the plurality of peripheral passages including a valve at common ends of the passages and the central passage not including a valve, the plurality of smaller passages and the larger central passage arranged in the common housing between the first and second ends; and a controller configured to:

vary a number of active adsorbent passages based on operating conditions.

11. The system of claim 10, wherein varying a number of active adsorbent passages based on operating conditions includes progressively opening and then closing valves on the ends of a select number of passages and wherein the operating conditions include an amount of fuel vapor in the canister.

12. The system of claim 10, wherein an outer wall of each adsorbent passage includes an electrically resistant material and wherein the controller is further configured to increase a current through the electrically resistant material when each adsorbent passage is activated.

13. A method comprising: flowing purge air through different first and second groups of parallel-tubular fuel vapor peripheral canister passages surrounding a circumference of a central passage depending on engine operating conditions, en route to an engine intake, passages of each of the first group and second groups each having a valve, the central passage not including a valve, all passages of the first and second groups and the central passage arranged in a common housing of a canister, where:

after purging the central passage and not the first and second groups of peripheral passages, in response to an amount of fuel vapor in the central passage being less than a first threshold, flowing purge air through all passages of the first and second groups of peripheral passages;

after flowing purge air through all the passages of the first and second groups of peripheral passages, in response to an amount of fuel vapor in the first and second groups of peripheral passages being less than a second threshold, flowing purge air through the first group of peripheral passages and not the second group of peripheral passages; and after flowing purge air through the first group of peripheral passages and not the second group of peripheral passages, in response to an amount of fuel vapor in the first group of peripheral passages being less than a third threshold, flowing purge air through the second group of peripheral passages and not the first group of peripheral passages.

14. The method of claim 13, further comprising in response to an amount of fuel vapor in the second group of peripheral passages being less than a fourth threshold, progressively purging the first and second groups of peripheral passages by selectively and progressively purging a smaller number of consecutive peripheral passages in the first and second groups, around the circumference of the central passage, until an amount of fuel vapor in the canister is less than a fifth threshold, smaller than the first, second, third, and fourth thresholds.

* * * * *